US006488118B1

(12) United States Patent
Corriveau

(10) Patent No.: US 6,488,118 B1
(45) Date of Patent: Dec. 3, 2002

(54) FALL ARREST BYPASS DEVICE AND METHOD FOR USING SAME

(76) Inventor: John A. Corriveau, 13520 W. Lisbon Rd., Brookfield, WI (US) 53007

( * ) Notice: Subject to any disclaimer, the term of this patent is extended or adjusted under 35 U.S.C. 154(b) by 0 days.

(21) Appl. No.: 09/562,229

(22) Filed: Apr. 27, 2000

(51) Int. Cl.[7] ..... A62B 37/00

(52) U.S. Cl. ..... 182/36; 104/111; 104/93; 104/112

(58) Field of Search ..... 182/10–12, 36, 182/3; 104/93, 113, 111, 112

(56) References Cited

U.S. PATENT DOCUMENTS

| | | | | |
|---|---|---|---|---|
| 301,923 A | * | 7/1884 | Reisdorff | 182/11 |
| 304,730 A | | 9/1884 | High | |
| 399,709 A | * | 3/1889 | Smith | 182/11 |
| 407,196 A | | 7/1889 | Glenn | |
| 413,270 A | | 10/1889 | Welch | |
| 628,872 A | | 7/1899 | Vieregg | |
| 857,924 A | * | 6/1907 | Crandall | |
| 1,094,213 A | | 4/1914 | Jones | |
| 1,683,578 A | | 9/1928 | Mobius et al. | |
| 5,224,427 A | | 7/1993 | Riches et al. | |
| 5,271,481 A | | 12/1993 | Rich | |
| 5,279,385 A | | 1/1994 | Riches et al. | |
| 5,297,651 A | | 3/1994 | Vandelinde | |
| 5,343,975 A | | 9/1994 | Riches et al. | |
| 5,687,812 A | | 11/1997 | Gervais et al. | |
| 5,979,599 A | | 11/1999 | Noles | |
| 6,009,973 A | | 1/2000 | Woodyard | |

OTHER PUBLICATIONS

Ramco—Derrick Glide, Ramco Ind, Inc., 1990.*
Promotional brochure, Protecta International. No date listed.
Promotional brochure, Fall Arrest Systems, Inc. No date listed.
Promotional brochure, Tactel Ltd. Jan. 1998.
Catalog, Carbis, Inc. p. 26. No date listed.

* cited by examiner

*Primary Examiner*—Alvin Chin-Shue
(74) *Attorney, Agent, or Firm*—Reinhart Boerner Van Deuren, s.c.

(57) ABSTRACT

An improved bypass device for a fall arrest system that is not impeded by cable supports as it is pulled along a flexible and/or rigid cable. The bypass device has a gate which can be quickly and easily removed from a frame of the bypass device to reveal an opening which allows the bypass device to be positioned on the cable. Once the bypass device is positioned on the cable, the gate may be reattached to the frame to partially close the opening. A portion of the opening remains unblocked by the gate so that the bypass device will pass over one or more cable supports when it is pulled along the cable. The cable supports act to guide the cable along a desired workpath. The supports are also constructed to withstand the force exerted on the cable in the event someone or something connected to the bypass device falls.

5 Claims, 4 Drawing Sheets

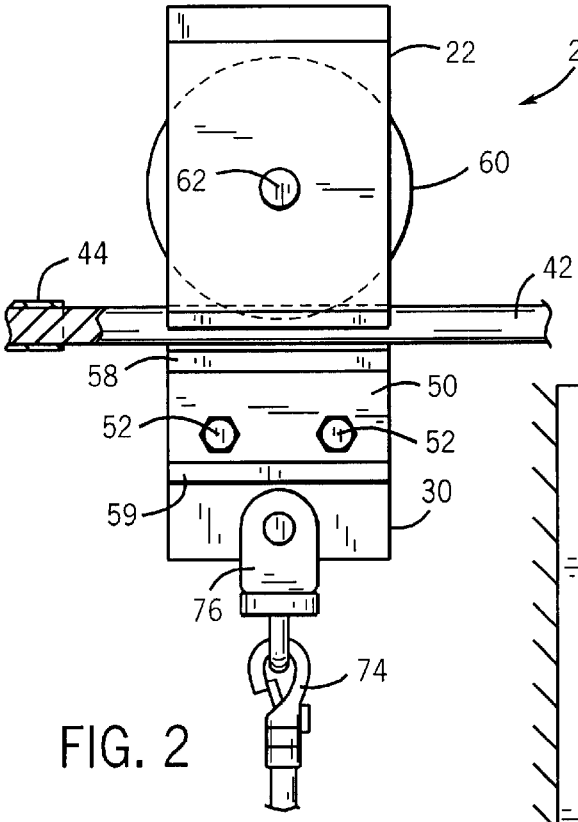
FIG. 2
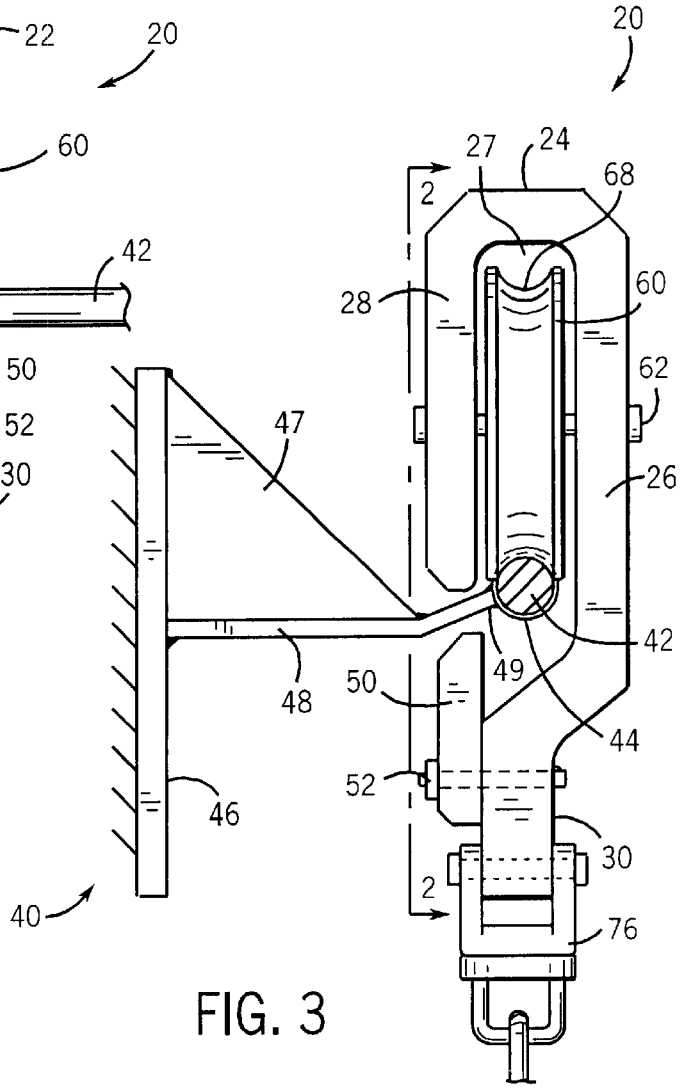
FIG. 3
FIG. 12
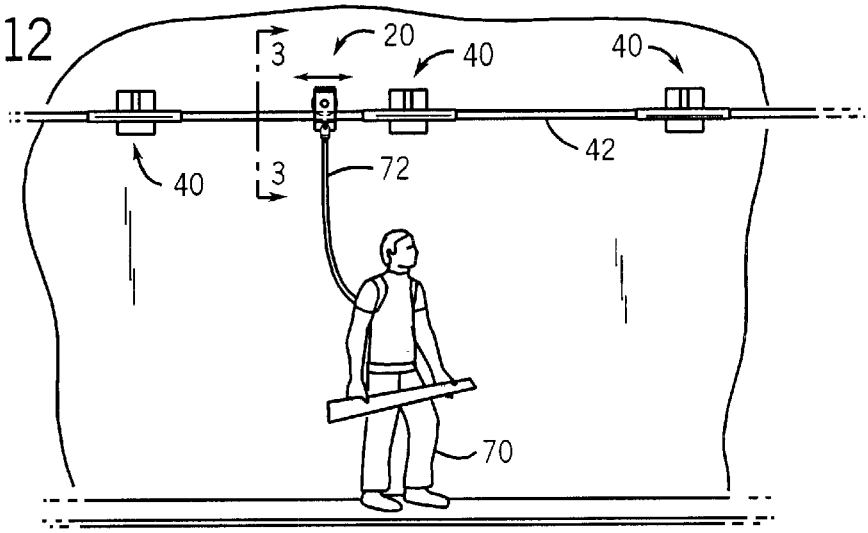

FALL ARREST BYPASS DEVICE AND METHOD FOR USING SAME

BACKGROUND OF THE INVENTION

Field of the Invention

The present invention relates generally to a safety apparatus which moves along a cable and serves as a support for a safety line or the like, and more particularly, to an improved fall arrest bypass device which may ride freely on a flexible and/or rigid cable without being impeded by cable supports intervally located along the cable.

Workers who perform tasks at heights on elevated or suspended platforms, and workers who operate near vertical edges need to be protected from falls that could cause injury or death. In fact, the U.S. government has established the Occupational Safety and Health Administration ("OSHA") to regulate employers having workers who perform job tasks in these types of environments. Under regulations enacted by OSHA, each employee must be protected by a safety system when walking or working on a surface higher than six feet above the ground or a lower level.

This safety system may be a fall arrest system which arrests an employee in a short distance following a fall from a working level. A conventional fall arrest system consists of an anchorage point, a harness, and a mechanism connecting the harness to the anchorage point. It may also include a lanyard, deceleration device, lifeline, or suitable combination of these elements. A personal fall arrest system must limit the maximum arresting force on an employee to 1800 pounds, and be rigged so that an employee cannot fall more than six feet or come in to contact with any lower level. The fall arrest system must also be constructed to have sufficient strength to withstand twice the potential impact energy of a free-fall of six feet or the stopping distance provided by the system, whichever is less.

Fall arrest systems which are presently in use are typically attached to a single fixed anchor point. A worker is connected to the fixed anchor point by a lanyard attached to a harness or safety belt worn by the worker. This single fixed anchor system is a safe option for performing tasks in a limited area, but many tasks require the worker to move over a larger area. In the latter situation, the worker must disconnect the lanyard from the fixed anchor point and reconnect it to another fixed anchor point. During the change-over time, the worker is in danger of falling, which could result in serious injury or death. As a result, the single fixed anchor point system severely limits the type of tasks a worker can safely and legally perform.

Other safety systems exist that provide more mobility than the single fixed anchor point system. For example, in a track system, a lanyard is attached at one end to the worker via a harness, and to a trolley, slide, or other movable component on the other end. The trolley, slide, or other movable component is adapted to move freely along a conventional track, which can be an I-beam, a metal or plastic rail, or a cable that is either supported at various points along a work path or is anchored safely at its two end points. The supports function to both hold the track in place and to support the weight of the trolley and one or more workers in the event of a fall. The track is usually directly overhead in relation to the worker's position, and can curve around corners or incline at angles. Some tracks such as I-beams require permanent installation.

Tracks like that described above typically require numerous supports which present an obstacle to conventional track-type fall arrest devices. A worker using a conventional fall arrest device must disconnect the device from the track between each support. Again, this places the worker in danger of falling. Additionally, these devices create wear on the track as well as the fall arrest device itself, which may result in frequent and costly replacement of parts.

Many tasks could be made easier and would benefit from a hands free fall arrest device that can pass freely over or through the track supports unaided by human intervention and unimpeded by undue frictional orientation of passing components. Designs of track-traveling and fall arrest devices that permit movement of a device past a plurality of local track supports are known. U.S. Pat. No. 304,730, to High, describes a truck that rides upon a gas-pipe track to move a fire escape ladder around a building. The truck disclosed by the High patent has two independent yokes, each with a carrying wheel adapted for the track. A gate is located on the rear side of the truck, and is hinged to the truck with a fulcrum-pin to allow the truck to pass through brackets that support the track. The truck described by the High patent is bulky and heavy, which prevents its use as a fall arrest device. Furthermore, these types of trucks are expensive to manufacture due to the redundant components that may be necessary to support an off-balance fire escape ladder, but are not necessary to support workers or other objects.

U.S. Pat. No. 5,979,599, to Noles, describes another track-traveling apparatus that rides upon a cable safety track which is supported by a plurality of supports. Noles discloses a track-traveling element with a single pulley that can ride upon the cable safety track. The track-traveling element has a slot which allows the element to pass over the brackets which support the cable. However, the track-traveling element disclosed by Noles cannot be removed from the cable safety track without severing the track or disengaging the track from its source. The permanence of the track-traveling element will cause it to be exposed to environmental conditions that could cause wear and corrosion, and prevents the track-traveling element from being easily removed and stored for later use.

To overcome the problems and disadvantages associated with the prior art, it is an objective of the improved bypass device of the present invention that it be strong enough to withstand the force of a falling object connected to the device. Furthermore, the bypass device should also be attached to a cable in a manner sufficient to hold a worker in case of a fall.

It is another objective that the improved bypass device of the present invention be capable of riding freely along a cable and passing over one or more support brackets without having to be removed from the track. The bypass device should also be able to ride freely around corners and curves of the track without having to be removed.

It is a further objective that the improved bypass device of the present invention be securely attached to the cable to prevent accidental disengagement that would place the worker in a dangerous situation. However, the improved bypass device of the present invention should also have a mechanism to easily remove it from the track so that the bypass device may be stored when not in use.

Another objective of the bypass device of the present invention is that it be lightweight with easily replaceable parts, and that it can be adapted to fit different size cables. The bypass device should ride freely on the cable without encountering significant friction, thereby preventing wear on the bypass device itself, as well as preventing the bypass device from causing any degree of wear to the support cable.

Finally, it is also an objective of the improved bypass device of the present invention that all of the aforesaid advantages and objectives be achieved without incurring any substantial relative disadvantage.

SUMMARY OF THE INVENTION

The disadvantages and limitations of the background art discussed above are overcome by the improved fall arrest bypass device which is taught by the present invention.

The bypass device is a component of a safety system which will meet and exceed applicable standards the government (OSHA) requires to protect workers having job duties at hazardous heights. The bypass device is attached at one end to a cable, and at the other end to a safety line extending to a harness of a worker. The safety line can be a rope lanyard, a retractable cable, webbing, or other types of lines known by those skilled in the art. The cable is engineered to support one or more workers in the event of a fall, and can be made from steel, nylon, polyester, or other well-known materials.

The cable should be held by supports located approximately every 20 feet to about 200 feet along the length of the cable, depending on the ground clearance and the flexibility of the cable used. The supports can hold the cable in a straight line, or, alternatively, the supports can be curved to wrap the cable around corners and over ledges. Each support may be mounted to the exterior of a building or rooftop along the work path, or, alternatively, the supports can be mounted upon poles along the work path. The supports are typically mounted by a mechanical securing device such as a bolt or other threaded fastener, or attached or mounted in other well-known ways including welding so that the supports can withstand the force exerted on the cable in the event one or more workers fall.

The bypass device connects the worker to the cable and is pulled along the cable and over the supports as the worker travels along the work path. The bypass device includes a frame member with a C-shaped body with two legs and an arm that extends downwardly from the base of the C-shaped body. The two legs surround a pulley located in a space therebetween. The pulley is grooved to fit in a mating relationship with the cable, and the pulley rotates around a pulley shaft with the assistance of a bearing so that it rides on the cable and over the supports with little friction. It would be apparent to one of skill in the art that the size and shape of the pulley will vary depending on the size of the cable and supports.

To attach the bypass device to the cable, the worker passes the cable through an opening to the interior space of the C-shaped body of the frame member. The opening is greater. than the cross-sectional diameter of the cable or section of the support holding the cable so as to allow the bypass device to pass onto the cable and support. Additionally, the opening permits the bypass device to pass over and through the supports when pulled along the cable.

To ensure that the bypass device remains engaged to the cable during use, a removable entry gate is attached to the frame member proximate the opening. The removable entry gate can either be attached to the arm of the frame member below the opening, or to one of the legs of the C-shaped body superior the opening. The gate reduces the size of the opening but does not close the opening completely. As a result, the opening is. made smaller than the cross-sectional diameter of the cable and supports and will prevent accidental disengagement during use. However, the partial opening is wide enough to allow a worker to pull the bypass device over the supports without having to detach the bypass device at each support.

The removable entry gate can be in a variety of shapes and sizes. For example, in one embodiment of the present invention, the removable entry gate is a single, substantially rectangular gate that partially blocks the opening to the interior of the body. Another embodiment may include two separate removable entry gates, each of which partially block the opening to ensure that the bypass device does not become disengaged from the cable. Because one of the purposes of the removable entry gate is to ensure that the bypass device remains engaged with the cable or supports, while allowing the bypass device to pass over the supports, one skilled in the art would realize that any imaginable embodiment of such a gate will fall within the scope of the present invention.

Once the removable entry gate is attached to the frame member, the worker is secured to the cable by the safety line attached to the arm of the frame member. The safety line may be attached to the arm directly by a latch, lockable D-ring, snap lock, or carabiner, or it may also be attached to a connector independently attached to the arm. The connector can be either a ring or swivel with a ring for attachment to the safety line. A swivel may allow for more mobility and a greater range of motion, however, it is not necessary for operation and use of the present invention.

Thus, it may be seen that the improved bypass device of the present invention overcomes the problems and disadvantages associated with the prior art by providing the aforesaid characteristics. The improved bypass device is strong enough to withstand the force of a falling object attached to the bypass device. Furthermore, the bypass device is removably attachable to a cable in a manner sufficient to hold a worker in case of a fall. The improved bypass device of the present invention also rides freely along a cable and can pass over support brackets, straight or curved, without having to be removed from the cable.

Furthermore, the improved bypass device of the present invention will remain engaged with the cable by its innovative use of a removable entry gate that prevents the bypass device from becoming disengaged from the cable, which would prevent a worker from being placed in a dangerous situation. This removable entry gate can also be easily removed so that the bypass device can be stored when not in use.

The bypass device of the present invention is also lightweight, with easily replaceable parts that can be adapted to fit cables of different size. The pulley of the bypass device allows the bypass device to ride freely on the cable without significant friction to prevent wear on the bypass device itself and prevent the bypass device from causing the cable to wear.

Finally, all of the aforesaid advantages and objectives are achieved without incurring any substantial relative disadvantage.

The above brief description sets forth rather broadly the more important features of the present invention so that the detailed description that follows may be better understood, and so that the present contributions to the art may be better appreciated. There are, of course, additional features of the invention that will be described hereinafter, which will form the subject matter of the invention. In this respect, before explaining an embodiment of the invention in detail, it is to be understood that the invention is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

DESCRIPTION OF THE DRAWINGS

These and other advantages of the present invention are best understood with reference to the drawings, in which:

FIG. 2 is a front elevation view of the bypass device shown in FIG. 1;

FIG. 3 is a side elevation view of the bypass device and the single support as illustrated in FIG. 1;

FIG. 12 is an isometric view of a worker using the bypass device of FIGS. 1–4 in combination with a cable supported by a plurality of supports in accordance with the teachings of the present invention.

DETAILED DESCRIPTION OF THE PREFERRED EMBODIMENT

Figure 1:
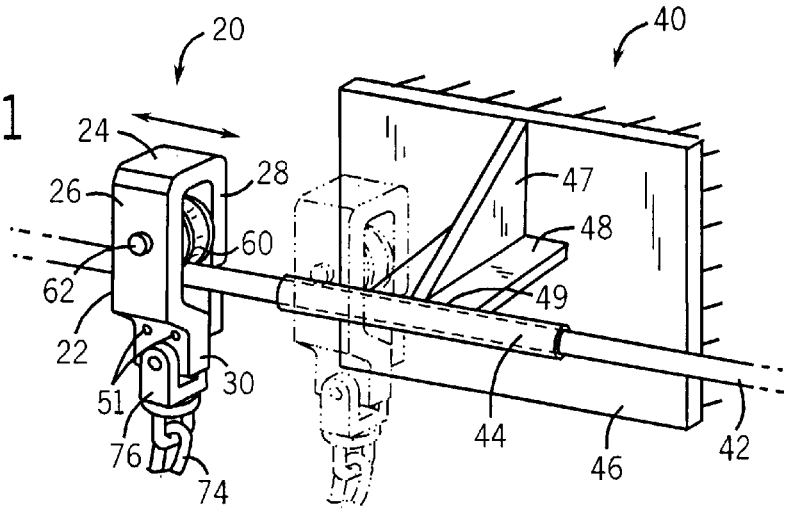
FIG. 1 is an isometric view of a bypass device and a support which are constructed in accordance with the preferred embodiment of the present invention.

Turning now to the drawings, and more particularly to FIG. 1 which illustrates a bypass device 20 of the present invention as used in combination with a cable 42 and a support 40. As is shown, the bypass device 20 travels along the cable 42 and passes over a guiding segment 44 of the support 40. Each of these features and the manner in which they are interrelated will be discussed in detail below.

FIGS. 1 and 3 illustrate a support 40 that holds a portion of a cable 42 along a desired work path for use in combination with a bypass device 20 of the present invention. The support 40 includes a base 46, an extension 48, and a guiding segment 44. The base 46 is shown as a parallelogram, but can be most any shape. The base 46 is the portion of the support 40 that is mounted to the exterior of a building or along a rooftop by conventional mounting methods including a mechanical securing device such as a threaded fastener or bolt, or by more permanent methods including welding. Alternatively, the base 46 of the support 40 may be mounted to a secured pole or mounting bracket.

The extension 48 projects outwardly from the base 46 at an angle substantially normal to the base 46 and can either be forged, molded, welded or joined to the base 46 by other less permanent methods including threaded fasteners or coupling devices. To further secure the extension 48 to the base 46, a fin 47 may also be used and can be joined to the base 46 and the extension 48 by similar methods. The guiding segment 44 is positioned at the terminal edge 47 of the of the extension 48. In one embodiment, the guiding segment 44 is a hollow cylindrical segment that extends along the terminal edge 49 of the extension 48. The hollow cylindrical segment has a diameter larger than the cross-sectional diameter of the cable 42, so that a portion of the cable 42 may pass therethrough as shown in FIG. 3. To ensure that the guiding segment 44 is sufficiently strong to withstand the force of a falling worker, the guiding segment 44 is either forged or welded to the extension 48.

All portions of the support 40 may be constructed from suitable materials such as 6061 aircraft aluminum, stainless steel, ceramic materials, and plastic materials. Additionally, other embodiments of the support 40 may have a guiding support 44 that is not a hollow cylindrical segment, but is in the shape of a "C" or "U" to support and guide the cable 42. Furthermore, it would be apparent to those skilled in the art to use alternative cable supports that can be used in conjunction with the bypass device 20 taught by the present invention.

One cable 42 that may be used in combination with the bypass device of the present invention is a ⅝" diameter polyester fiber cable manufactured by Wall Industries, Inc., U.S.A. and sold under the PERMACABLE trademark by Sellstrom Manufacturing Company, U.S.A. A portion of the cable 42 passes through the hollow cylindrical segment 44 to prevent sagging in the cable 42, and to provide sufficient tension to hold a worker in the event a worker falls. Although the cable described above is one available cable, other types of cables may be used in combination with the bypass device 20 including cables made from polysteel, steel, KEVLAR by DuPont, U.S.A., or other synthetic materials.

FIGS. 1–4 depict one embodiment of a bypass device 20 constructed in accordance with the present invention. The bypass device 20 includes a frame member 22 with a body 24 and an arm 30. The body 24 is formed in a shape similar to an upper case letter "C," as shown in FIG. 5, although the shape of the body 24 may vary. FIGS. 1–5 illustrate a body 24 of the frame member 22 with two legs 26 and 28 that may be substantially parallel. The arm 30 extends downward from the base of the C-shaped body 24. The legs 26 and 28 are separated by a distance to create a space 27 therebetween to house a pulley 60 shown in FIGS. 1–4. One leg 26 of the C-shaped body 24 can be continuous with the downward extending arm 30. The other leg 28 of the C-shaped body 24 is suspended over the downward extending arm 30 to create an opening 32 to the space 27 between the legs 26 and 28 of the C-shaped body 24.

The frame member 22 can be made from a suitable material such as 6061 aircraft aluminum. However, other embodiments constructed in accordance with the present invention may utilize other materials known to those of skill in the art including stainless steel, ceramic materials, and plastic materials. Additionally, the frame member 22 can be made from a single piece of material, or may be constructed from multiple pieces of the same material, or from multiple pieces of different types of materials, as would be apparent to one skilled in the art.

Referring to FIG. 3, the opening 32 to the space 27 between the legs 26 and 28 of the C-shaped body 24 is wider than the cross-sectional area of the cable 42 or the guiding segment 44 to permit the worker to place the bypass device 20 onto the cable 42. Because different cables and supports may be used, the width of the opening 32 will vary depending on the size and shape of the cable 42 and supports 40 as they are used in combination with the bypass device 30.

Figure 4:
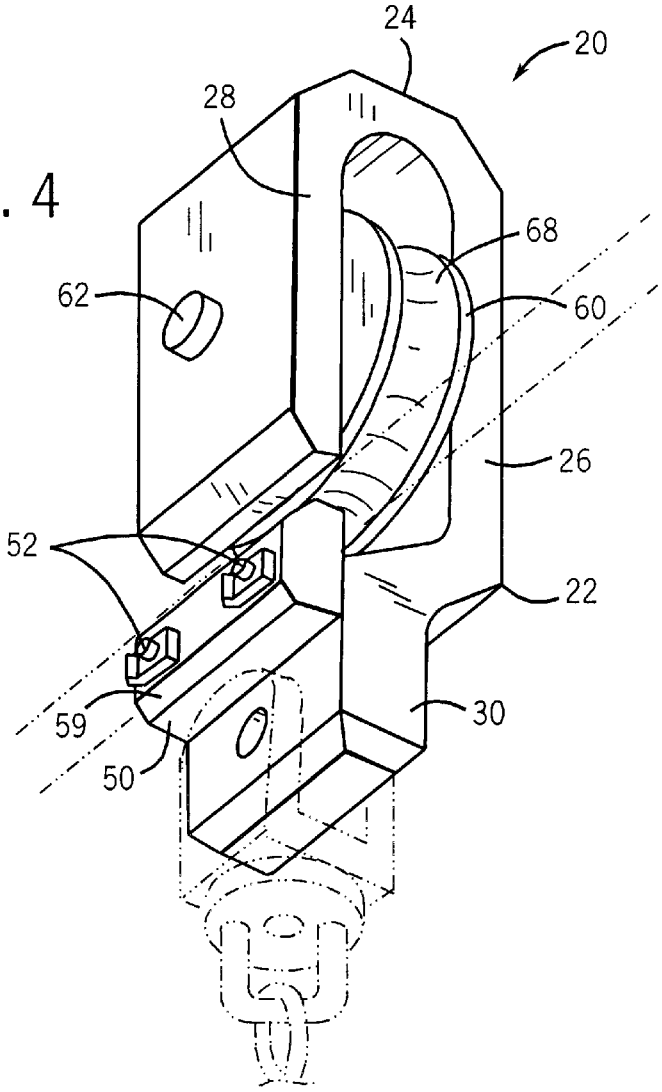
FIG. 4 is an isometric front view of the bypass device shown in FIG. 1 from a lower angle.
Figure 5:
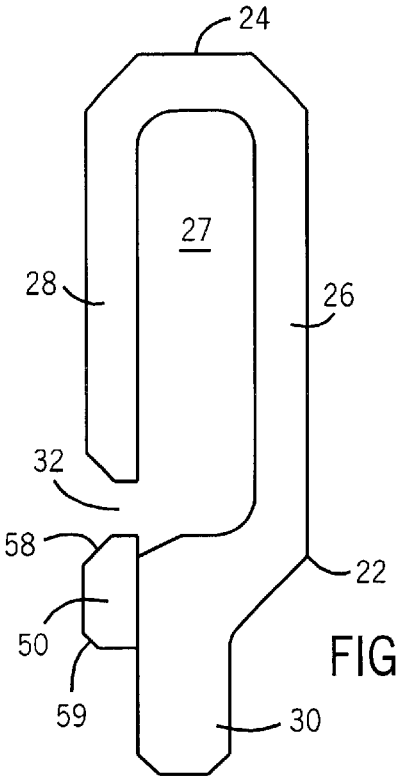
FIG. 5 is a side elevation view of the bypass device shown in FIG. 1 without a pulley.

Once the bypass device 20 is positioned on the cable 42 or the guiding segment 44 as shown in FIGS. 1–4, the bypass device 20 may be removably engaged with the cable 42 by a. removable entry gate 50. The entry gate 50 can be attached to the frame member 22 proximate the opening 32 by at least one removable fastener 52 such as a bolt or a detent pin as shown in FIGS. 2 and 4, respectively. Other types of removable fasteners may also be used including bendable and non-bendable cotter pins or other removable fasteners 52 known by those skilled in the art.

In one embodiment, the removable entry gate 50 is attached to the downward extending arm 30 beneath the opening 32. However, other embodiments of the present invention locate the removable entry gate 50 on the leg 28 superior the opening 32. Once attached, the entry gate 50 partially blocks the opening 32, thereby reducing the width of the opening 32 to a size smaller than the cross-sectional area of the cable 42 or guiding segment 44. This ensures that the bypass device 20 will remain engaged to the cable during use, and also allows the bypass device 20 to pass through the supports 40 without having to be removed.

Figure 6:
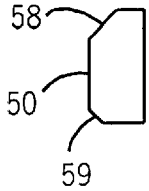
FIG. 6 is a side elevation view of the removable entry gate shown in FIG. 1.
Figure 7:
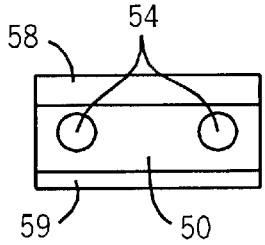
FIG. 7 is a front elevation view of the removable entry gate illustrated in FIG. 1.

One embodiment of the removable entry gate 50 is more clearly shown in FIGS. 6 and 7. The removable fasteners 52 shown in FIGS. 2 and 4 are inserted in one or more attachment holes 54 and then pass into one or more mating holes 51 tapped or bored into the arm 30 of the frame member 22 as shown in FIG. 1. FIG. 7 also illustrates one embodiment of the removable entry gate 50 as being substantially rectangular with a beveled top portion 58 and bottom portion 59 to provide a greater range of motion for the bypass device 20 as it used in combination with the cable 52 and supports 40. However, other embodiments of the present invention may have one or more removable entry gates of varying size and shape for the purpose of preventing disengagement of the bypass device 20 from the cable 42.

Figure 8:
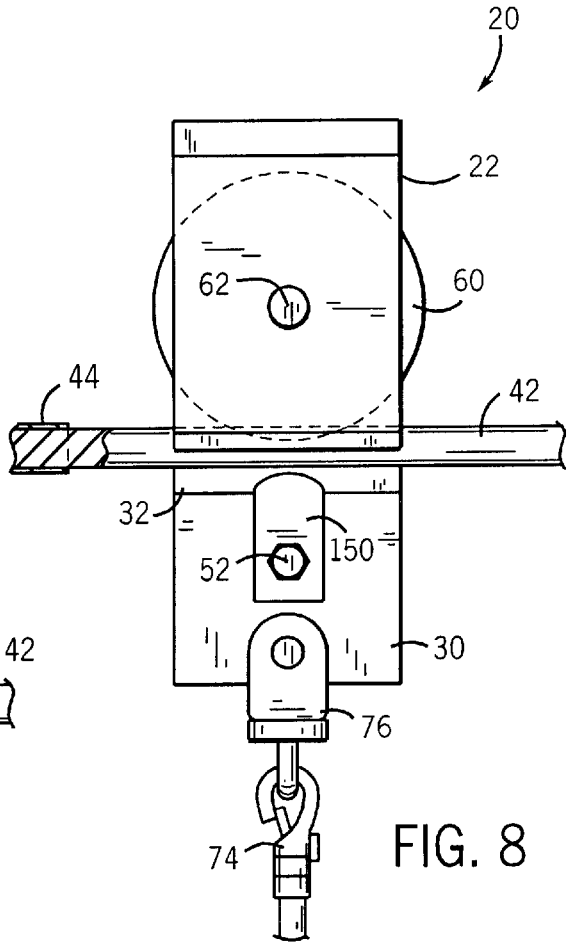
FIG. 8 is a front elevation view of the bypass device shown in FIG. 1 with an alternative removable entry gate which is constructed in accordance with the teachings of the present invention.
Figure 9:
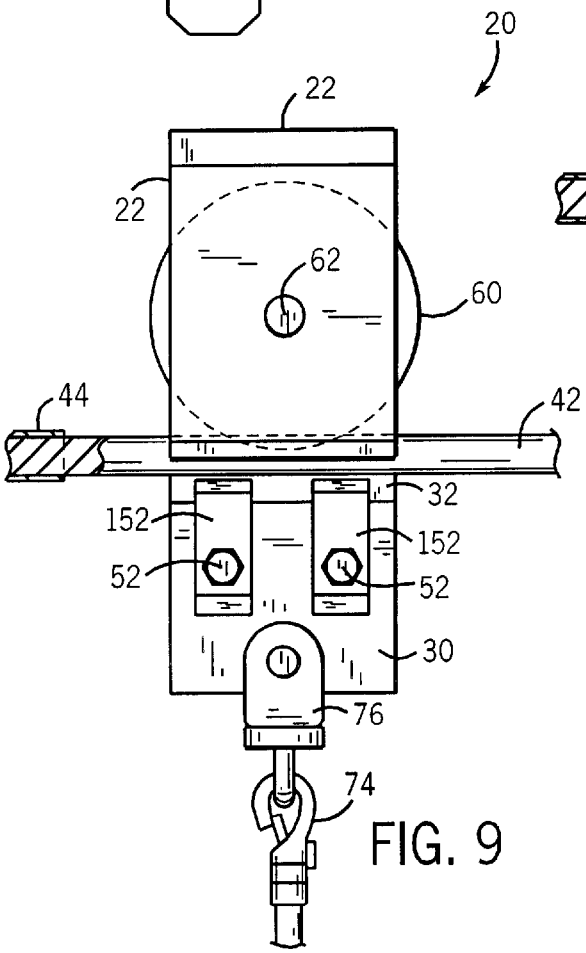
FIG. 9 is a front elevation view of the bypass device shown in FIG. 1 with two removable entry gates which is constructed in accordance with the teachings of the present invention.

For example, FIG. 8 illustrates a bypass device 20 with a single entry gate 150 with a width less than the width of the arm 30. FIG. 9 shows another embodiment of the present invention with two removable entry gates 152 that are removably attached to the arm 30. From these examples, it would be readily apparent to one skilled in the art to use one or more entry gates which may be in a variety of shapes and sizes so long as the gate(s) reduces the size of the opening 32 to prevent the bypass device 20 from disengaging with the cable 42 or a portion of the supports.

When the worker places the bypass device 20 onto the cable 42 or hollow cylindrical segment 44, the pulley 60 bears the weight of the bypass device 20 and the attached worker as is shown in FIGS. 1–4. The pulley 60 is positioned within the space of the frame member 22 between the two legs 26 and 28 of the C-shaped body 24, and is mounted to the frame member 22 by a pulley shaft 62 extending through the legs 26 and 28 and the pulley 60. The pulley shaft 62 may be a bolt or rod with end caps to prevent the pulley shaft 62 from coming loose.

Figure 10:
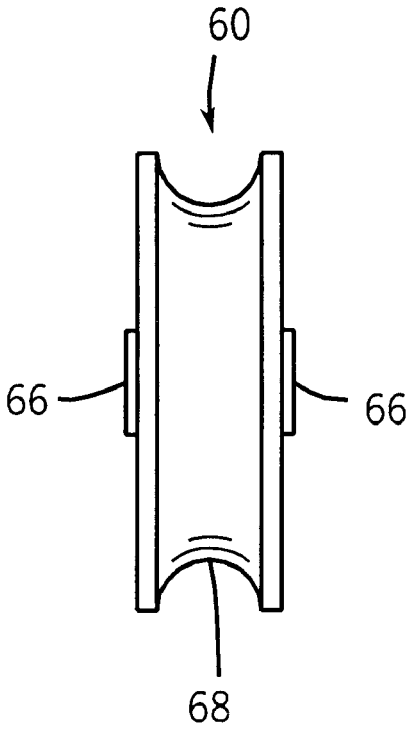
FIG. 10 is a side elevation view of a pulley of the bypass device as shown in FIG. 1.
Figure 11:
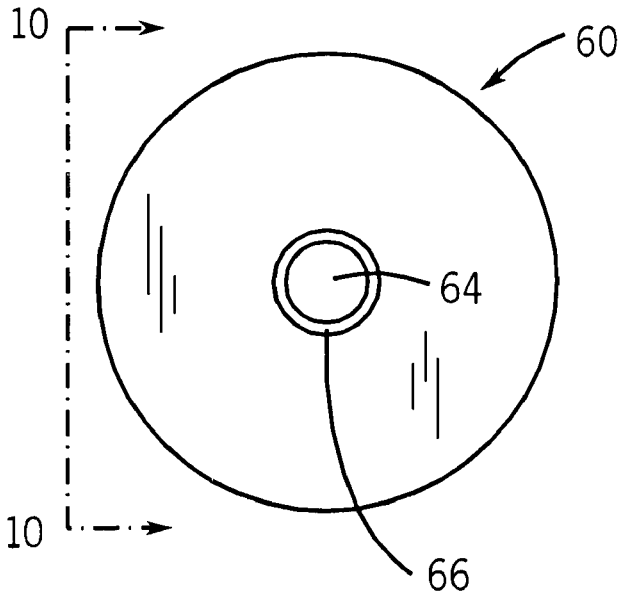
FIG. 11 is a front elevation view of the pulley of the bypass device shown in FIG. 10.

The pulley 60 is more clearly displayed in FIGS. 10 and 11. FIG. 11 shows a center hole 64 with a bearing or bushing 66 that is coaxially located therein to allow the pulley 60 to rotate freely around the pulley shaft 62, thereby reducing friction when the bypass device 20 is pulled along the cable 42 and over the hollow cylindrical segments 44. The pulley 60 engages the cable 42 and hollow cylindrical segment 44 at a groove 68 machined into the radial edge of the pulley 60. Like the frame member 22, the pulley 60 can be made from aluminum, stainless steel, plastic or other materials known by those skilled in the art, and it can vary in size depending on the diameter or shape of the cable 42 and supports 40. Furthermore, the radius or depth of the groove 68 may also vary in size to fit the cross-sectional area of the cable 42 or hollow cylindrical segment 44.

FIG. 12 illustrates a worker 70 using the bypass device 20 in combination with the cable 42 and a plurality of supports 40. As the worker 70 travels along the work path, the worker 70 pulls the bypass device 20 along the cable 42 and over each support 40. The cable 42 is held along a work path by a plurality of supports 40 mounted to a larger structure. The number of supports 40 can vary depending on the flexibility and type of cable used in the safety system.

The worker 70 is connected to the cable 42 by a safety line 72 that is rated for a fall arrest system. Often times, the safety line 72 is expandable or includes a separate shock absorbing mechanism (not shown). The safety line 72 can be connected to the downward extending arm 30 of the frame member 22 either directly by a clip 74 attached to the safety line 72 as shown in FIG. 2, or it can be indirectly attached to the bypass device 20 by a connector 76 as shown in FIGS. 1–4. Methods of connecting the safety line 72 to the bypass device 20 are well-known by those skilled in the art and can include the use of lockable dee-rings, snap hooks, and carabiners. These same devices can also be used as connectors. However, in one embodiment of the present invention, the connector 76 is a swivel that is rated to hold 13600 pounds as is shown in FIG. 4. The swivel connector allows the worker to move and rotate freely without twisting the safety line.

The advantages of the disclosed invention are thus attained in an economical, practical and facile manner. While preferred embodiments and example configurations have been shown and described, it is to be understood that various further modifications and additional configurations are apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A combination comprising:

(a) a cable extending in overlying relation to a surface below;

(b) at least one support to guide said cable along a path and to mount said cable to an object; said support comprising:

a base for mounting to said object;

an extension joined to said base and extending outwardly from said base; and said extension having a thickness which is less than the diameter of said cable;

a guiding segment joined to said extension, said guiding segment locating a portion of said cable along said path and supporting any force exerted on said cable; and (c) a bypass device removably coupled to said cable, said bypass device adapted to travel along said cable, said bypass device comprising:

a pulley in operative relation with said cable;

a frame member at least partially enclosing said pulley, said frame member defining an opening to said pulley to allow said cable to pass therethrough;

a pulley shaft connecting said pulley to said frame member; and at least one gate removably attached to said frame member in a fixed position in which said gate only partially blocks said opening, when said gate is attached to said frame member, to allow said extension to pass through said partially blocked opening when the gate is in said fixed position while preventing said cable from passing through said partially blocked opening, thereby eliminating the need to uncouple said bypass device from said cable at said support.

2. The combination of claim 1, wherein:

said frame member includes a body and an arm, said body having a first leg and a second leg, said first leg continuous with said arm, and said second leg suspended superior said arm to define said opening, said opening having a width to permit a cable to pass therethrough, and said gate is removably coupled to said arm, said gate partially blocking said opening to prevent said cable from passing through said opening but allowing said extension to pass therethrough.

3. The combination of claim 1, wherein said guiding segment is a hollow cylindrical segment coaxial with a portion of said cable.

4. The combination of claim 1, further comprising a detent pin to removably couple said gate to said frame member.

5. The combination of claim 1, including a second gate removably attached to said frame member, each of said gates partially blocking said opening to prevent a cable from passing through said opening.

* * * * *